US005174417A

United States Patent [19]

Pilsbury

[11] Patent Number: 5,174,417

[45] Date of Patent: Dec. 29, 1992

[54] DEVICE AND METHOD FOR THE ACTUATING AND UNLATCHING OF THE SHAFT DOORS OF AN ELEVATOR

[75] Inventor: Richard H. Pilsbury, Morristown, N.J.

[73] Assignee: Inventio AG, Hergiswil, Switzerland

[21] Appl. No.: 651,798

[22] Filed: Feb. 7, 1991

[51] Int. Cl.[5] ..... B66B 13/00

[52] U.S. Cl. ..... 187/52 LC; 187/61

[58] Field of Search ..... 187/51, 52, 52 LC, 61; 49/118, 120

[56] References Cited

U.S. PATENT DOCUMENTS

| | | | |
|---|---|---|---|
| 1,842,806 | 1/1932 | Shonnard et al. | 187/52 LC |
| 1,876,438 | 9/1932 | Werner . | |
| 1,911,792 | 5/1933 | Boedtcher | 187/52 LC |
| 2,481,124 | 9/1949 | Kruger | 187/52 |
| 2,996,152 | 8/1961 | Olexson et al. | 187/52 LC |
| 3,638,762 | 2/1972 | Johns | 187/52 LC |

FOREIGN PATENT DOCUMENTS

| | | |
|---|---|---|
| 589207 | 6/1977 | Switzerland . |
| 587984 | 5/1945 | United Kingdom . |
| 2182713 | 5/1987 | United Kingdom . |

OTHER PUBLICATIONS

English abstract of Japanese Patent Document No. 54-140339.

English abstract of Japanese Patent Document No. 2-43193.

European Search Report and Annex.

*Primary Examiner*—Robert P. Olszewski

*Assistant Examiner*—Kenneth Noland

*Attorney, Agent, or Firm*—Sandler, Greenblum, & Bernstein

[57] ABSTRACT

A device for opening and closing a shaft door of an elevator and a method of use thereof. The device includes a first coupling member adapted to be positioned on the shaft door and a second coupling member being adapted to be positioned on a car door on an elevator car. The first coupling member and the second coupling member cooperate with each other to couple the shaft door to the car door for movement therewith when the car is at a landing, the first coupling member cooperating with the second coupling member without contact between the first coupling member and the second coupling member. By means of the foregoing arrangement, noises and vibrations, which arise from the opening and unlatching of a shaft door entrained by a driven car door, can largely be avoided. The first and second coupling member are preferably magnets, which are arranged in such a manner that a north pole of the first coupling member lies opposite a north pole of the second coupling member and a south pole of the first coupling member lies opposite a south pole of the second coupling member. The like poles repel each other and are thereby separated by an air gap. A further magnet, one pole of which in the direction of movement of the doors lies opposite with an air gap to a like pole of the second coupling member, is provided on a latching member of the shaft door. When a car stops at a landing, the shaft door is first unlatched without contact and then is entrained by the car door without contact upon the opening of the car door due to the repelling forces of the magnets.

23 Claims, 2 Drawing Sheets

DEVICE AND METHOD FOR THE ACTUATING AND UNLATCHING OF THE SHAFT DOORS OF AN ELEVATOR

BACKGROUND OF THE INVENTION

1. Field of the Invention

The present invention is directed to a device for the actuating and unlatching of the shaft doors of an elevator. The device includes a first coupling member which is positioned on the landing or shaft door and a second coupling member which is positioned on the car door and can be brought into engagement with the first coupling member in the region of a floor or landing of a building. A latching mechanism is provided on the shaft door and on the car. When the car stops at a landing, the latch is in effective connection with the second coupling member in such a manner that the shaft door is unlatched and can be opened. This device opens or closes horizontally displaceable car and shaft doors simultaneously, when stopping at a landing, by means of a door drive mounted on the car.

2. Description of Background and Other Information

A device for the simultaneous actuation of the car and shaft doors of an elevator installation is illustrated in British Patent No. 587,984, and related U.S. Pat. No. 2,481,124, wherein an electromagnet which is positioned on the car actuates a coupling member which is movably mounted on the car door by a lever linkage. The coupling member has a wedge-shaped cross-section and is held in a disengaged position when the electromagnet is turned on. A fixed coupling member mounted on the shaft door includes a V-shaped groove, which is adapted to engage the wedge-shaped cross-section of the movable coupling member. When the car stops at a landing, the electromagnet is turned off, and both the coupling members come into engagement by means of spring force. In this case, the movable coupling member presses on a roller carried by a lever so that a rod fastened at the other end of the lever is upwardly displaced. The upper end of the rod is connected with a pawl which is thereby pivoted upwardly, so that the shaft door is unlatched and a control circuit is opened.

In another known device, disclosed in U.S. Pat. No. 1,876,438, an electromagnet is installed in the car door above a movable coupling member and is connected by a joint With the coupling member. The movable coupling member is held in a disengaged position by gravitational force. When the electromagnet is turned on, it comes into engagement with a fixed coupling member mounted on the shaft door. A further electromagnet mounted on the car is connected with a lever arrangement, in which a dog is articulately fastened. The dog lies against a roller which is carried by a lever, while the lever is connected with a pawl and arranged to be rotatable on the shaft door. At the beginning of the door opening movement, the further electromagnet is turned off so that the dog is moved downwardly and presses against the roller. In this case, the lever, and thereby also the pawl, carry out a pivotal movement so that the shaft door is unlatched and a control circuit is opened.

Noises and vibrations, which may be unpleasant to the passengers, in the above-described devices occur by the engaging and disengaging of the coupling members as well as by the electromagnets being switched on and off. In order to ensure unobjectionable engaging of the coupling members, both coupling members must lie opposite each other as exactly as possible, so that production and assembly must be highly accurate.

SUMMARY OF THE INVENTION

The present invention is directed to a device in which noises and vibrations which occur by the engaging and disengaging of the coupling members and unlatching and latching of the shaft doors are avoided, no high accuracy demands need be set on production and assembly, and fewer mechanical components are needed.

According to one aspect of the invention, the coupling members include magnets which are constructed in such a manner that, in the region of a landing, a north pole of the first magnet lies opposite a north pole of the second magnet and a south pole of the first magnet lies opposite a south pole of the second magnet in the direction of movement of the doors. Each respective poles are thereby separated by an air gap by the repelling force of the like poles. A further magnet, which is positioned in the region of a landing includes one pole opposite a like pole of the second coupling member and also includes an air gap therebetween in direction of movement of the doors.

An advantage achieved by the present invention is that noises and vibrations are largely avoided because of the contactless entrainment of the shaft door and the contactless actuation of the latching member. Also, the shaft door gradually slows down shortly before the end of the door movement each time by the repelling forces of the like poles. The doors can be opened more rapidly and the effective open time of the door is increased, since the small initial speed, which is required in some conventional devices for coupling and unlatching, is not necessary.

Other advantages are that fewer mechanical components are needed and, because of the air gaps between the magnet poles, larger production and assembly tolerances are permissible. Also, in the case of a stop at a landing and a voltage failure, the doors can be opened by hand, since mechanical contact can be produced between the coupling members and between the second coupling member and the latching member.

Therefore, in view of the foregoing, according to one aspect of the invention, the invention can be defined as a device for actuating and unlatching a shaft door of an elevator and includes a first coupling member positioned on the shaft door and a second coupling member, which is positioned on the car door of an elevator car. The second coupling member is adapted to be brought into cooperation with the first coupling member in the region of a landing. A latching member is provided on the shaft door so that when the car stops at a landing, the latching member is in effective connection with the second coupling member in such a manner that the shaft door is unlatched and can be opened.

The coupling members may be magnets, wherein at least one of the coupling members is an electromagnet. A north pole of the first coupling member is positioned adjacent a north pole of the second coupling member and a south pole of the first coupling member is positioned adjacent a south pole of the second coupling member when the car is at a landing. The respective north poles and south poles are separated by a respective air gap.

A further magnet may be positioned in the region of a landing. One pole of the further magnet is positioned adjacent a like pole of the second coupling member when the car is at a landing, and the further magnet is mounted on the latching member. When the car stops at a landing, the repelling forces of the magnets cause the shaft door to be first unlatched without contact with the car door. The shaft door then is entrained without contact by the car door for opening of the car door.

According to a further aspect of the invention, the first coupling member is a U-shaped permanent magnet having two legs forming poles. The second coupling member comprises two electromagnets, a respective side of each electromagnet overlapping a respective leg of the U-shaped permanent magnet. An air gap is formed between each side and a respective leg. Alternatively, the first coupling member is a U-shaped electromagnet having two legs forming poles.

The latching member includes a pawl which is rotatable with respect to the shaft door, and a toggle lever, which includes a first lever and a second lever. The first lever and the second lever each include a first end and a second end, and are pivotally connected with the other at each first end. The second end of the first lever is rotatable on the pawl and the second end of the second lever is rotatable with respect to the shaft door. The further magnet is a rod-shaped permanent magnet which is connected with the toggle lever in the region of the first end of both the first lever and the second lever.

An object of the present invention, therefore, is to provide a device for opening and closing a shaft door of an elevator, wherein the device includes a first coupling member adapted to be positioned on the shaft door, and a second coupling member being adapted to be positioned on a car door of an elevator car. The first coupling member and the second coupling member cooperate with each other to couple the shaft door to the car door for movement therewith when the car is at a landing. The first coupling member cooperates with the second coupling member without contact between the first coupling member and the second coupling member.

The first coupling member comprises a first magnet having a north pole and a south pole. The second coupling member comprises at least one magnet having a north pole and a south pole and the first magnet is positioned so that at least one of the north pole and the south pole is adjacent at least one of the north pole and the south pole, respectively, of the second magnet, when the car is at a landing.

The first magnet may be a U-shaped permanent magnet having first and second legs forming the north pole and the south pole, respectively, or the first magnet may be a U-shaped electromagnet having first and second legs forming the north pole and the south pole, respectively. The second coupling member may comprise at least one electromagnet, and preferably comprises two electromagnets. The first coupling member is a U-shaped magnet having first and second legs forming the north pole and south pole, respectively, and the U-shaped magnet is positioned between the two electromagnets when the car is at a landing.

Another object of the invention is to provide a latching member for latching the shaft door. The latching member includes a further coupling member for cooperating with the second coupling member, without contact between the latching member and the second coupling member, for unlatching the shaft door. The latching member includes a pawl which is rotatable with respect to the shaft door; a first lever having a first and second end; and a second lever having a first and second end. The first lever and the second lever are pivotally connected together at each respective first end. The second end of the first lever is pivotally connected to the pawl, and the second end of the second lever is pivotally connected to the shaft door. The further cooperating member is located at the first ends of the first lever and the second lever.

According to an aspect of the invention, the second coupling member comprises at least one first magnet, and the further coupling member comprises a second magnet. Like poles of the respective first magnet and the second magnet are positioned adjacent each other when the car is at a landing, so that the like poles repel each other to pivot the latching member to an unlatched position. The first magnet may be an electromagnet, so that the electromagnet may be turned off to allow the latching member to move to a latched position.

Another aspect of the invention is to provide a method of opening and closing a shaft door o f an elevator, wherein the elevator includes a car having a car door. The method comprises the steps of moving the car to a landing; opening the car door; and coupling the shaft door to the car door for movement therewith. The coupling is without contact between the car door and the shaft door.

The coupling includes providing a first magnet on the shaft door and a second magnet on the car door, wherein like poles of the first and second magnet are adjacent to each other when the car is positioned at the landing.

The method further includes unlatching a latching member on the shaft door when the car is positioned at the landing.

The step of unlatching includes providing a magnet on the car door and a magnet on the latching member. Like poles of the magnet on the car door and the magnet on the latching member are adjacent to each other when the car is positioned at the landing, whereby the like poles repel each other to move the latching member to an unlatched position.

BRIEF DESCRIPTION OF THE DRAWINGS

The invention is further explained in the description which follows with reference to the drawings illustrating, by way of a non-limiting example, an embodiment of the invention wherein.

DETAILED DESCRIPTION OF THE PREFERRED EMBODIMENTS

Figure 1:
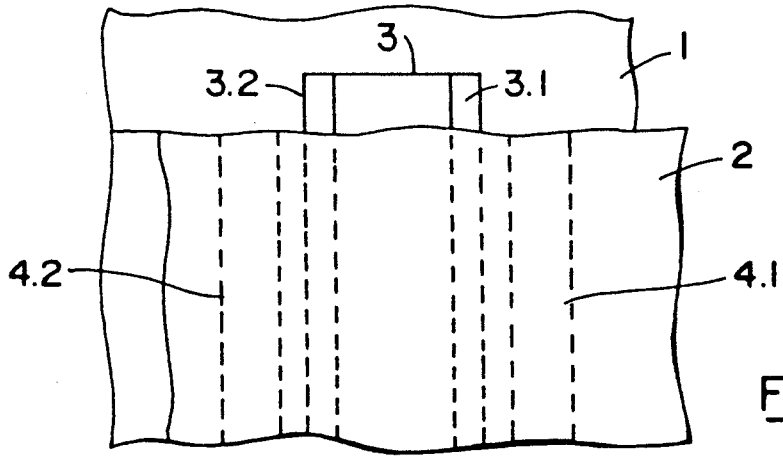
FIG. 1 is a partial elevation of the car and shaft door of an elevator with the coupling members of the device according to the present invention.
Figure 2:
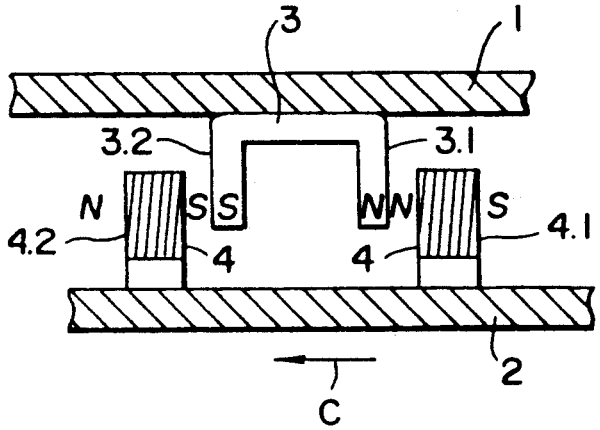
FIG. 2 is a cross-section of the car and shaft door of the device according to FIG. 1.

In FIGS. 1 and 2, a shaft door is denoted by 1 and a car door of an elevator is denoted by 2. A first coupling member 3 is positioned on shaft door 1 and a second coupling member 4 on car door 2. Coupling member 3 and 4 are preferably magnets of equal pole strength, wherein first coupling member 3 may be a U-shaped permanent magnet and second coupling member 4 may be two like electromagnets 4.1 and 4.2. Coupling members 3 and 4 are arranged in such a manner that electromagnets 4.1 and 4.2 include an air gap and overlap legs 3.1 and 3.2, which, in the region of a landing, form magnet poles at the outer sides of the U-shaped permanent magnet. In this case, the north pole N of one electromagnet 4.1 is adjacent the north pole N of leg 3.1 and the south pole S of electromagnet 4.2 is adjacent the south pole S of leg 3.2 of U-shaped permanent magnet 3 as illustrated in FIG. 2. In a further embodiment, a small U-shaped electromagnet can be used in place of U-shaped permanent magnet 3, wherein one limb 3.1 forms a north pole and the other limb 3.2 forms a south pole.

Figure 3:
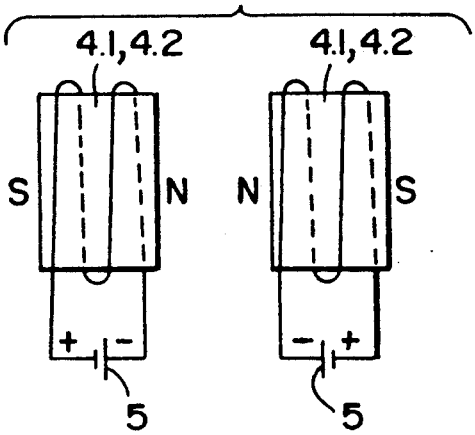
FIG. 3 is a schematic illustration of the electromagnets of a coupling member of the device according to the present invention.

According to FIG. 3, the electromagnets 4.1 and 4.2 are known, in principle, and include hollow coils with cores of ferromagnetic material, wherein as is likewise known, the electromagnets can be changed in polarity through exchange of the terminals of a direct current source 5.

Figure 4:
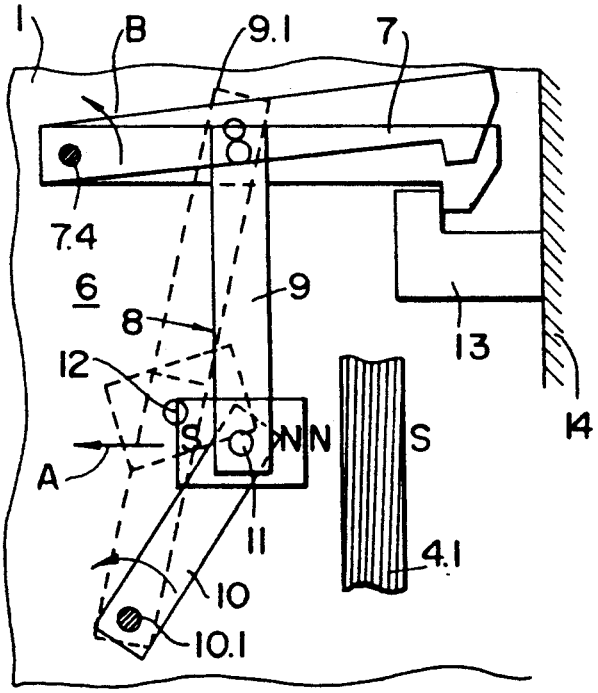
FIG. 4 illustrates a latching member of the device according to the present invention in the latched and unlatched positions.
Figure 5:
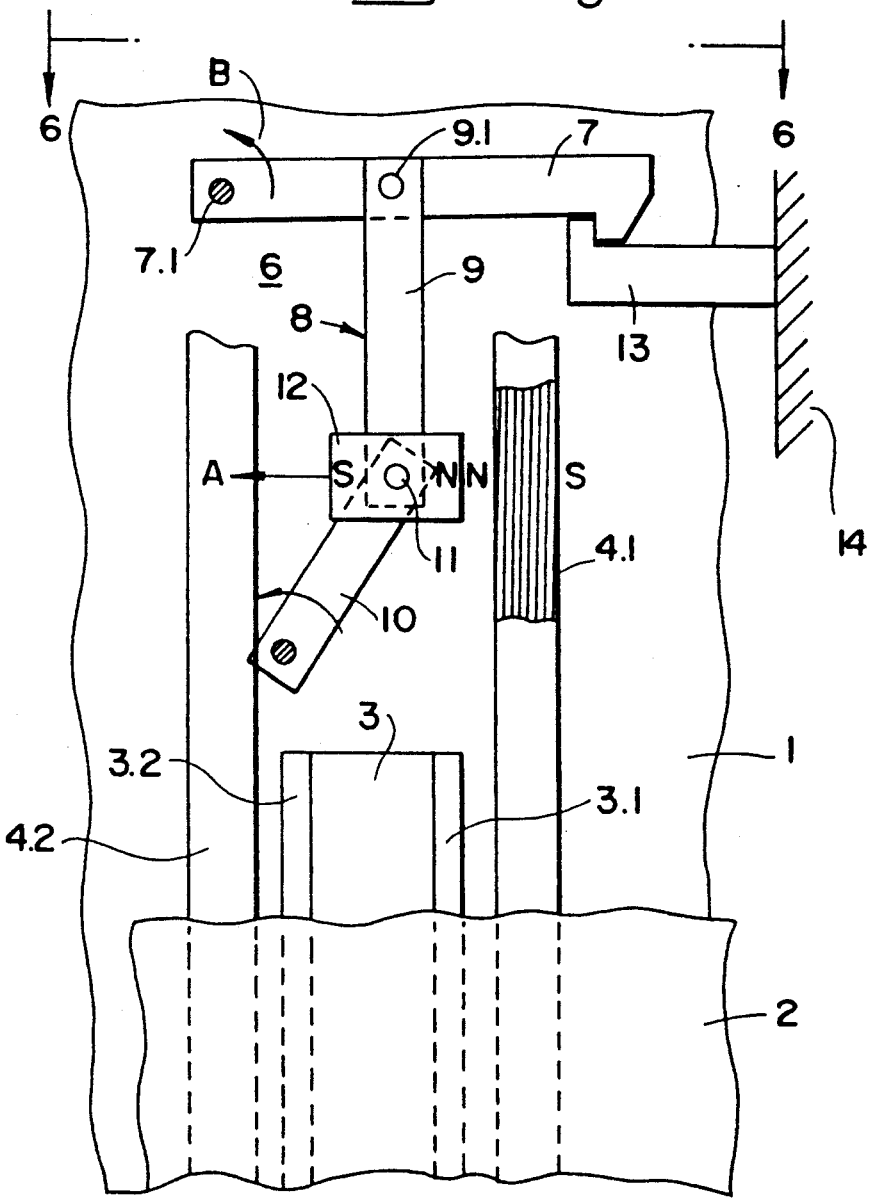
FIG. 5 is a partial elevation of the car door and shaft door, illustrating the relationship between the latching member and coupling members.
Figure 6:
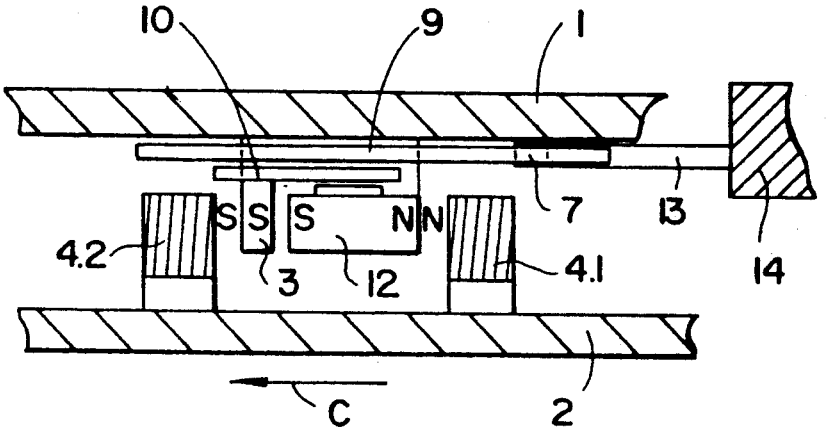
FIG. 6 is a cross-sectional view taken along line 6—6 of FIG. 5.

Referring to FIGS. 4–6, latching member 6 includes a pawl 7, which is rotatable with respect to shaft door 1, at pivot 7.1 and a toggle lever 8. Toggle lever 8 includes a first lever 9 and a second lever 10, which levers are articulately connected to each other at a first end comprising a common fulcrum 11. The other end of the first lever 9 is mounted to be rotatable on pawl 7, at pivot 9.1, while the other end of the second lever 10 is rotatable with respect to shaft door 1 at pivot 10.1 A rod-shaped permanent magnet 12 is fastened at toggle lever 8 in the region of common fulcrum 11 of both levers 9 and 10. One pole of magnet 12 becomes opposite to a like pole of second coupling member 4 and includes an air gap in the direction of movement of the doors. When shaft door 1 is closed, pawl 7 is latched to a shaft door frame at 13.

The device described above operates as follows:

When stopping at a landing, the electromagnetic second coupling part 4 is activated first, i.e., by having electric power applied thereto, thereby moving the toggle lever 8, without contact, in the direction of Arrow A (FIG. 4), and the pawl 7 is hereby pivoted upwardly in the direction of Arrow B due to the repelling forces of the like poles, for example, two north poles of rod-shaped permanent magnet 12 and of electromagnet 4.1, so that shaft door 1 becomes unlatched, as shown in dashed lines in FIG. 4. Thereafter, a known door drive (not shown) arranged on the car is started and shaft door 1 is entrained without contact by car door 2 due to the repelling forces acting between first coupling part 3 and second coupling part 4. In the case of the direction of movement of the doors, for example characterized by Arrow C (FIGS. 2 and 6), the air gap between electromagnet 4.1 and leg 3.1 of permanent magnet 3 becomes smaller during acceleration and the repelling forces between the north poles N become larger. After the acceleration, an equilibrium state occurs because of the equal pole strengths, wherein the U-shaped permanent magnet 3 lies in the center between electromagnets 4.1 and 4.2. During deceleration, the air gap between electromagnet 4.2 and limb 3.2 of the permanent magnet becomes smaller, while the repelling forces between the south poles S increase at the same time, so that shaft door 1 gradually slows down to a stop. When Closing the doors, substantially the same process takes place in reverse sequence form the opening. After closing the door, the electromagnet second coupling part 4 is de-activated, while pawl 7 drops and shaft door 11 is again latched.

Although the invention has been described with reference to particular means, materials and embodiments, it is to be understood that the invention is not limited to the particulars disclosed and extends to all equivalents within the scope of the claims.

What is claimed:

1. Device for actuating and unlatching a shaft door of an elevator, said device including a first coupling member positioned on said shaft door and a second coupling member, which is positioned at the car door of an elevator car, said second coupling member being adapted to be brought into cooperation with said first coupling member in the region of a landing, wherein a latching member is provided on said shaft door so that when the car stops at a landing, said latching member is in effective connection with said second coupling member in such a manner that the shaft door is unlatched and can be opened, said device comprising:

said coupling members being magnets, wherein at least one of the said coupling members is an electromagnet;

a north pole of said first coupling member being positioned adjacent a north pole of said second coupling member and a south pole of said first coupling member being position adjacent a south pole of said second coupling member when the car is at a landing, said respective north poles and south poles being separated by a respective air gap; and a further magnet being positioned in the region of a landing, one pole of said further magnet being positioned adjacent a like pole of said second coupling member when the car is at a landing, said further magnet being mounted on said latching member;

wherein, when the car stops at a landing, the repelling forces of the magnets cause said shaft door to be first unlatched without contact with said car door, and the said shaft door then being entrained without contact by said car door for opening of said car door.

2. Device according to claim 1, wherein said first coupling member is a U-shaped permanent magnet having two legs forming poles, said second coupling member comprises two electromagnets, a respective side of each electromagnet overlapping a respective leg of said U-shaped permanent magnet, and an air gap being formed between each said side and a respective leg.

3. Device according to claim 1, wherein said first coupling member is a U-shaped electromagnet having two legs forming poles, and said second coupling member comprises two electromagnets, a respective side of each second coupling member overlapping a respective leg, which form magnetic poles of the U-shaped electromagnet, and an air gap being formed between each said side and a respective leg.

4. Device according to claim 1, wherein:

said latching member includes a pawl which is rotatable with respect to said shaft door, and a toggle lever, which includes a first lever and a second lever, said first lever and said second lever each having a first end and a second end, said first lever and said second lever being pivotally connected with the other at each said first end;

said second end of said first lever being rotatable on said pawl, and said second end of said second lever being rotatable with respect to said shaft door; and said further magnet being a rod-shaped permanent magnet which is connected with said toggle lever in the region of said first end of both said first lever and said second lever.

5. Device for opening and closing a shaft door of an elevator, said device including a first coupling member adapted to be positioned on the shaft door, a second coupling member being adapted to be positioned on a car door of an elevator car, said first coupling member and said second coupling member cooperating with each other to couple the shaft door to the car door for movement therewith when the car is at a landing, said first coupling member cooperating with said second coupling member without contact between said first coupling member and said second coupling member, and further comprising a latching member for latching said shaft door, said latching member including a further coupling member for cooperating with said second coupling member, without contact between said further coupling member and said second coupling member, for unlatching said shaft door.

6. Device according to claim 5, wherein said first coupling member comprises a first magnet having a north pole and a south pole, said second coupling member comprising at least one magnet having a north pole and a south pole, said first magnet being positioned so that at least one of said north pole and said south pole is adjacent at least one of said north pole and said south pole, respectively, of said second magnet, when the car is at a landing.

7. Device according to claim 6, wherein said first magnet is a U-shaped permanent magnet having first and second legs forming the north pole and the south pole, respectively.

8. Device according to claim 6, wherein said first magnet is a U-shaped electromagnet having first and second legs forming the north pole and the south pole, respectively.

9. Device according to claim 5, wherein said second coupling member comprises at least one electromagnet.

10. Device according to claim 9, wherein said second coupling member comprises two electromagnets.

11. Device according to claim 10, wherein said first coupling member is a U-shaped magnet having first and second legs forming a north pole and south pole, respectively, said U-shaped magnet being positioned between said two electromagnets when the car is at a landing.

12. Device for opening and closing a shaft door of an elevator, said device including a first coupling member adapted to be positioned on the shaft door, a second coupling member being adapted to be positioned on a car door of an elevator car, said first coupling member and said second coupling member cooperating with each other to couple the shaft door to the car door for movement therewith when the car is at a landing, said first coupling member cooperating with said second coupling member without contact between said first coupling member and said second coupling member, wherein said first coupling member comprises a first magnet having a north pole and a south pole, said second coupling member comprising at least one magnet having a north pole and a south pole, said first magnet being positioned so that at least one of said north pole and said south pole is adjacent at least one of said north pole and said south pole, respectively, of said second magnet, when the car is at a landing.

13. Device according to claim 12, further comprising a latching member for latching said shaft door, said latching member including a further coupling member for cooperating with said second coupling member, without contact between said latching member and said second coupling member, for unlatching said shaft door.

14. Device according to claim 13, said latching member comprising:

a) a pawl which is rotatable with respect to said shaft door;

b) a first lever having a first and second end;

c) a second lever having a first and second end; and d) said first lever and said second lever being pivotally connected together at each respective first end to form a common fulcrum, said second end of said first lever being pivotally connected to said pawl, said second end of said second lever being pivotally connected to said shaft door.

15. Device according to claim 14, wherein said further cooperating member is located at said common fulcrum of said first lever and said second lever.

16. Device according to claim 15, wherein said second coupling member comprises at least one first magnet, said further coupling member comprising a second magnet, like poles of said respective first magnet and said second magnet being positioned adjacent each other when the car is at a landing, so that the like poles repel each other to pivot said latching member to an unlatched position.

17. Device according to claim 16, wherein said first magnet is an electromagnet, said electromagnet being turned off to allow said latching member to move to a latched position.

18. Method of opening and closing a shaft door of an elevator, the elevator including a car having a car door, the method comprising the steps of:

a) moving the car to a landing;

b) opening said car door; and c) coupling said shaft door to said car door for movement therewith, by providing a first magnet on said shaft door and a second magnet on said car door, wherein like poles of said first and second magnet are adjacent to each other when said car is positioned at the landing, said coupling being without contact between said car door and said shaft door.

19. A method according to claim 18, wherein said coupling includes providing a first magnet on said shaft door and a second magnet on said car door, wherein like poles of said first and second magnet are adjacent to each other when said car is positioned at the landing.

20. Method according to claim 18 further comprising unlatching a latching member on said shaft door when said car is positioned at the landing.

21. Method according to claim 20, comprising providing a magnet on said car door and a magnet on said latching member, like poles of said magnet on said car door and said magnet on said latching member being adjacent to each other when said car is positioned at the landing, whereby said like poles repel each other to move the latching member to an unlatched position.

22. Device for opening and closing a shaft door of an elevator, said device including a first coupling member adapted to be positioned on the shaft door, a second coupling member being adapted to be positioned on a car door of an elevator car, said second coupling member comprising two electromagnets, said first coupling member being a U-shaped magnet having first and second legs forming a north pole and a south pole, respectively, said U-shaped magnet being positioned between said two electromagnets when the car is at a landing, wherein said first coupling member and said second coupling member cooperate with each other to couple the shaft door to the car door for movement therewith when the car is at the landing, said first coupling member cooperating with said second coupling member without contact between said first coupling member and said second coupling member.

23. Method of opening and closing a shaft door of an elevator, the elevator including a car having a car door, the method comprising the steps of:

a) moving the car to a landing;
b) opening said car door; and
c) coupling said shaft door to said car door for movement therewith, said coupling being without contact between said car door and said shaft door;
d) unlatching a latching member on said shaft door when said car is positioned at the landing; and
e) providing a magnet on said car door and a magnet on said latching member, like poles of said magnet on said car door and said magnet on said latching member being adjacent to each other when said car is positioned at the landing, whereby said like poles repel each other to move the latching member to an unlatched position.

* * * * *